US011506202B2

(12) United States Patent
Zhai et al.

(10) Patent No.: US 11,506,202 B2
(45) Date of Patent: Nov. 22, 2022

(54) PUMP BODY ASSEMBLY, COMPRESSOR AND AIR CONDITIONER

(71) Applicant: GREE GREEN REFRIGERATION TECHNOLOGY CENTER CO.,LTD.OF ZHUHAI, Zhuhai (CN)

(72) Inventors: Yuanbin Zhai, Zhuhai (CN); Ouxiang Yang, Zhuhai (CN); Peizhen Que, Zhuhai (CN); Yanjun Hu, Zhuhai (CN); Liu Xiang, Zhuhai (CN)

(73) Assignee: Gree Green Refrigeration Technology Center CO., LTD. of Zhuhai, Zhuhai (CN)

( * ) Notice: Subject to any disclaimer, the term of this patent is extended or adjusted under 35 U.S.C. 154(b) by 220 days.

(21) Appl. No.: 16/645,831

(22) PCT Filed: Jul. 3, 2018

(86) PCT No.: PCT/CN2018/094286

§ 371 (c)(1),
(2) Date: Mar. 10, 2020

(87) PCT Pub. No.: WO2019/105037

PCT Pub. Date: Jun. 6, 2019

(65) Prior Publication Data

US 2020/0284258 A1 Sep. 10, 2020

(30) Foreign Application Priority Data

Dec. 1, 2017 (CN) ..... 201711258557.5

(51) Int. Cl.
*F04C 18/356* (2006.01)
*F04C 29/00* (2006.01)

(52) U.S. Cl.
CPC ..... *F04C 18/356* (2013.01); *F04C 29/005* (2013.01)

(58) Field of Classification Search
CPC ..... F04C 18/356; F04C 29/005
See application file for complete search history.

(56) References Cited

U.S. PATENT DOCUMENTS

2002/0155741 A1* 10/2002 Herrick ..... F04B 39/121 439/199
2011/0286865 A1* 11/2011 Han ..... F04C 18/356 417/321

(Continued)

FOREIGN PATENT DOCUMENTS

CN 1779262 A 5/2006
CN 1782409 A 6/2006

(Continued)

OTHER PUBLICATIONS

Annotated Figure 1 of US-20170248138-A1 (Furya) (Year: 2017).*

(Continued)

*Primary Examiner* — Connor J Tremarche
(74) *Attorney, Agent, or Firm* — Armstrong Teasdale LLP

(57) ABSTRACT

A pump body assembly, a compressor and an air conditioner. The pump body assembly includes: an upper flange. The upper flange includes a disc portion and a neck portion extending upward from the disc portion, an outer peripheral surface of the disc portion is connected with a housing of the compressor, a height a1 of the disc portion and a distance b1 between an upper end surface of the neck portion and a lower end surface of the disc portion satisfy: 0.3≤a1/b1≤0.4, and the height a1 of the disc portion and a diameter d1 of the disc portion satisfy: 0.1≤a1/d1≤0.2.

15 Claims, 4 Drawing Sheets

(56) References Cited

U.S. PATENT DOCUMENTS

| | | | | |
|---|---|---|---|---|
| 2015/0125322 | A1* | 5/2015 | Chiang | F04C 29/028 417/415 |
| 2016/0305429 | A1 | 10/2016 | Zhou et al. | |
| 2017/0248138 | A1* | 8/2017 | Furuya | F04C 29/0057 |

FOREIGN PATENT DOCUMENTS

| | | | | |
|---|---|---|---|---|
| CN | 101684799 | A | 3/2010 | |
| CN | 206111557 | U | 4/2017 | |
| CN | 207568858 | U | 7/2018 | |
| EP | 3214263 | A1 | 9/2017 | |
| JP | S61155686 | A | 7/1986 | |
| JP | 2001355586 | A | 12/2001 | |
| JP | 2005180317 | A | 7/2005 | |
| WO | 2015096017 | A1 | 7/2015 | |
| WO | WO-2015096017 | A1 * | 7/2015 | F04C 18/3564 |

OTHER PUBLICATIONS

International Search Report for corresponding International Application No. PCT/CN2018/094286, dated Oct. 11, 2018, 2 pages.
Supplementary European Search Report for corresponding European Application No. 18883099.6, dated May 17, 2021, 9 pages.

* cited by examiner

PUMP BODY ASSEMBLY, COMPRESSOR AND AIR CONDITIONER

CROSS-REFERENCE TO RELATED APPLICATIONS

This application is a national phase entry under 35 U.S.C. § 371 of International Patent Application PCT/CN2018/094286, filed Jul. 3, 2018, and published as International Patent Publication WO2019/105037 A1 on Jun. 6, 2019, which claims the benefit of Chinese Patent Application Serial No. 201711258557.5, filed on Dec. 1, 2017, the disclosure of which are hereby incorporated by reference herein in their entirety.

TECHNICAL FIELD

The present disclosure relates to a field of an air conditioner, and in particular to a pump body assembly, a compressor and an air conditioner.

BACKGROUND

A rotary compressor consists of a motor assembly and a pump body assembly sealed inside a housing, and the motor assembly consists of a stator fixed on an inner wall of the housing and a rotor connecting with the pump body assembly. A maximum deviation of axes of the stator and the rotor in a motor is called coaxiality. The coaxiality of the motor is crucial to operation of the compressor. If the motor has poor coaxiality, namely, an axis deviation of the rotor and the stator is great, the rotor may generate an uneven electric magnetic force during rotation, thereby influencing stable operation of the compressor and generating electromagnetic noise. In a severe case, an outer wall of the rotor and an inner wall of the stator may be worn, namely, the motor may be subjected to sweeping, and even the compressor may be scrapped. Therefore, improvement of the coaxiality of the motor may improve reliability of the compressor, and reduce the noise.

For example, a device known to the inventors provides a method of improving coaxiality of a motor. The method ensures a gap between a rotor and a stator by using an upper flange for supporting of double layers inside of a compressor housing. Compared with a compressor known to the inventors, an additional bearing needs to be mounted on an upper portion of the motor in the method, thereby not only increasing cost and process complexity, but increasing abrasion and loss, and accordingly influencing properties of the compressor. In addition, the bearing may be trapped in reliability problem when operating under a situation of oil shortage.

SUMMARY

Some embodiments of the present disclosure provide a pump assembly, a compressor and an air conditioner, as to solve the problem that reliability of the compressor is influence and noise is caused because a motor of the compressor in the device known to the inventors has poor coaxiality.

For achieving the abovementioned purpose, according to an aspect of the present disclosure, a pump body assembly is provided, including an upper flange. The upper flange includes a disc portion and a neck portion extending upward from the disc portion, and an outer peripheral surface of the disc portion is connected with a housing of a compressor. A height a1 of the disc portion and a distance 131 between an upper end surface of the neck portion and a lower end surface of the disc portion satisfy: $0.3 \le a1/b1 \le 0.4$; and the height a1 of the disc portion and a diameter d1 of the disc portion satisfy: $0.1 \le a1/d1 \le 0.2$.

According to another aspect of the present disclosure, a pump body assembly is provided, including an upper flange and a cylinder configured under the upper flange. The upper flange includes a disc portion and a neck portion extending upward from the disc portion, and an outer peripheral surface of the cylinder is connected with a housing of a compressor. A height a2 of the outer peripheral surface of the cylinder and a distance b2 between an upper end surface of the neck portion and a lower end surface of the cylinder satisfy: $0.2 \le a2/b2 \le 0.3$, and the height a2 of the outer peripheral surface of the cylinder and a diameter d2 of the cylinder satisfy: $0.1 \le a2/d2 \le 0.2$.

According to another aspect of the present disclosure, a compressor is provided, including the abovementioned pump body assembly.

In some embodiments, the compressor further includes a rotating shaft provided inside the pump body assembly and a rotor sleeved on the rotating shaft in a penetrating manner, and the height a1 of the disc portion and a distance B1 between an upper end surface of the rotor and a lower end surface of the disc portion satisfy: $0.15 \le a1/B1 \le 0.25$.

In some embodiments, the compressor further includes the rotating shaft provided inside the pump body assembly and the rotor sleeved on the rotating shaft in a penetrating manner, and the pump body assembly further includes a cylinder and a lower flange. The lower flange is disposed under an upper flange, and the cylinder is disposed between the upper flange and the lower flange. The height a1 of the disc portion and a distance L between the upper end surface of the rotor and a lower end surface of the rotating shaft satisfy: $0.05 \le a1/L \le 0.15$.

In some embodiments, a lower end surface of the rotor is provided with a concave portion, and an upper end surface of the neck portion extends into the concave portion.

In some embodiments, the compressor further includes a housing sleeved outside the pump body assembly, and there is a gap between the housing and the pump body assembly. The height a1 of the disc portion and a width (D−d1) of the gap satisfy: $100 \le a1/(D-d1) \le 140$, where, D is an inner diameter of the housing, and d1 is a diameter of the disc portion of the pump body assembly.

In some embodiments, the disc portion is welded on the housing, and the cylinder is connected to the disc portion through a fastener.

In some embodiments, the compressor further includes a support welded and fixed on the housing, the disc portion is fixedly disposed on the support, and the cylinder is connected with the disc portion through the fastener.

In some embodiments, the compressor is a single-cylinder compressor or a multi-cylinder compressor.

In some embodiments, the compressor is a vertical compressor or a horizontal compressor.

According to another aspect of the present disclosure, an air conditioner is provided, including a compressor. The compressor is the abovementioned compressor.

With the adoption of the technical solution of the present disclosure, a ratio of the height of the disc portion of the upper flange to the diameter of the disc portion and a ratio of the height of the disc portion to a total height of the upper flange is improved, and the upper flange of the embodiment, from the upper flanges of identical diameter, has a greater height of the disc portion. Accordingly, there is a greater fitting area between the disc portion and the housing. When applied to the compressor housings of identical diameter, the flange of the present disclosure has a smaller inclined angle. Accordingly, the coaxiality of the motor is improved, probability of sweeping is reduced, noise is reduced, and reliability of the compressor is improved.

BRIEF DESCRIPTION OF THE DRAWINGS

The accompanying drawings described herein are used to provide a further understanding of the present disclosure, and constitute a portion of the present disclosure, and the exemplary embodiments of the present disclosure and the description thereof are used to explain the present disclosure, but do not constitute improper limitations to the present disclosure. In the drawings.

Figure 1:
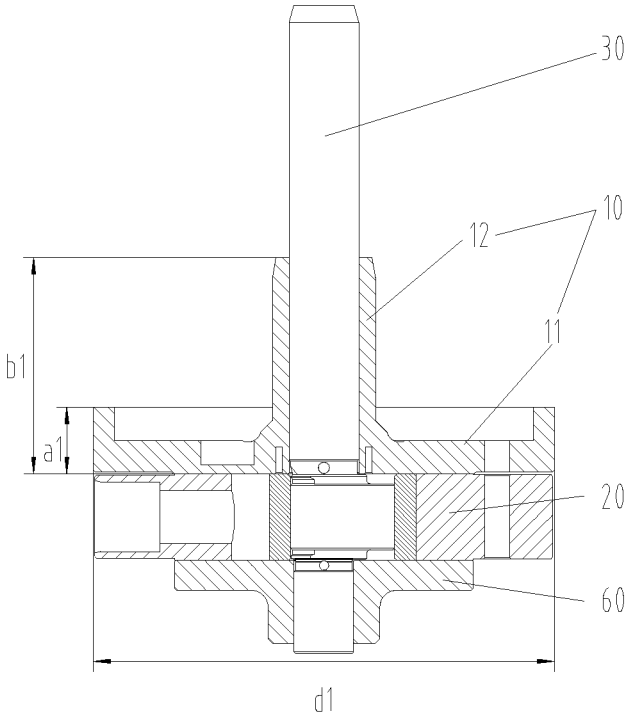
FIG. 1 is a schematic diagram of a section structure of an embodiment 1 of a pump body assembly according to the present disclosure.

Herein, the abovementioned drawings may include the following reference numbers:

10: Upper flange; 11: Disc portion; 12: Neck portion; 20: Cylinder; 30: Rotating shaft; 40: Rotor; 41: Concave portion; 50: Housing; 60: Lower flange; 70: Stator.

DETAILED DESCRIPTION OF THE EMBODIMENTS

The technical solutions in the embodiments of the disclosure will be clearly and completely described below in combination with the drawings in the embodiments of the disclosure. It is apparent that the described embodiments are not all embodiments but part of embodiments of the disclosure. The description below of at least one exemplary embodiment is merely illustrative in fact and not intended to limit the disclosure and disclosure or use thereof. All other embodiments obtained by those of ordinary skill in the art on the basis of the embodiments in the disclosure without creative work shall fall within the scope of protection of the disclosure.

It is to be noted that terms used herein are merely intended to describe the specific embodiments rather than intended to limit the exemplary embodiment of the disclosure. Unless otherwise explicitly indicated, a singular form is also intended to include a plural form. In addition, it should also be understood that terms "include" and/or "comprise" used in the description indicate that there are features, steps, operations, devices, assemblies and/or combinations thereof.

Unless otherwise specifically described, relative configurations, digital expressions and values of the parts and steps elaborated in these embodiments are not intended to limit the scope of the disclosure. Meanwhile, it should be understood that dimensions of all parts shown in the drawings are not drawn according to an actual proportionate relationship. The technologies, methods and devices known by those of ordinary skill in the art may not be discussed in detail. But, where appropriate, the technologies, methods and devices should be deemed as a part of the authorized description. In all examples shown and discussed herein, any specific value should be explained to be exemplary only rather than explained as limitation. Therefore, other examples of the exemplary embodiments may have different values. It is to be noted that similar reference numbers and similar letters indicate similar terms in the drawings below. Therefore, once a certain item is defined in one drawing, the item does not need to be further discussed in a subsequent drawing.

As shown in FIG. 1, a pump body assembly of an embodiment 1 includes an upper flange 10. The upper flange 10 includes a disc portion 11 and a neck portion 12 extending upward from the disc portion 11, and an outer peripheral surface of the disc portion 11 is connected with a housing of a compressor. A height a1 of the disc portion 11 and a distance b1 between an upper end surface of the neck portion 12 and a lower end surface of the disc portion 11 satisfy: $0.3 \leq a1/b1 \leq 0.4$, where b1 is a total height of the upper flange 10, and the height a1 of the disc portion 11 and a diameter d1 of the disc portion 11 satisfy: $0.1 \leq a1/d1 \leq 0.2$.

With the adoption of the technical solution of the embodiment, a ratio of the height of the disc portion 11 of the upper flange 10 to the diameter of the disc portion 11 and a ratio of the height of the disc portion 11 to the total height of the upper flange 10 is improved, and the upper flange of the embodiment, from the upper flanges of identical diameter, has a greater height of the disc portion. Accordingly, there is a greater fitting area between the disc portion 11 and the housing. When applied to the compressor housings of identical diameter, the flange of the embodiment has a smaller inclined angle. Accordingly, coaxiality of a motor is improved, probability of sweeping is reduced, noise is reduced, and reliability of the compressor is improved.

Figure 2:
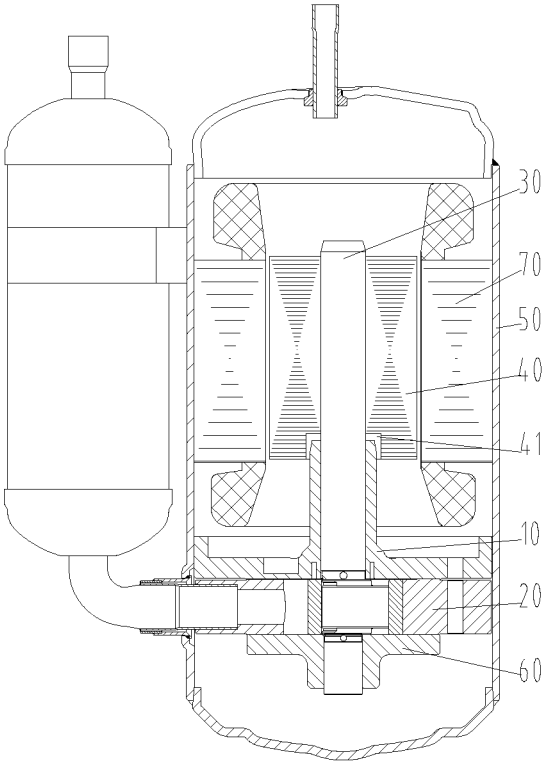
FIG. 2 is a schematic diagram of a section structure of an embodiment of a compressor according to the present disclosure.

The disclosure further provides a compressor. As shown in FIG. 2, the compressor according to the embodiment of the disclosure includes a housing 50, a motor assembly, a pump body assembly and a rotating shaft 30. The housing 50 includes an upper seal head and a lower seal head playing a role of sealing, and there is a gap between the housing 50 and the pump body assembly. The pump body assembly is the abovementioned pump body assembly and disposed inside the housing 50, as to compress and discharge gas of a refrigerant. As shown in FIG. 1 and FIG. 2, the pump body assembly of the embodiment further includes a cylinder 20 and a lower flange 60. The lower flange 60 is disposed under an upper flange 10, the cylinder 20 is disposed between the upper flange 10 and the lower flange 60, the rotating shaft 30 is provided inside the pump body assembly in a penetrating manner, and the motor assembly is disposed on the rotating shaft 30. The rotating shaft 30, in presence of driving of the motor assembly, drives a roller to rotate in the cylinder 20, as to compress the gas. The compressor of the embodiment has high coaxiality, low noise, strong reliability and long service life.

The compressors of the embodiments do not need an additional bearing for supporting, thereby simplifying a pump body structure and a compressor structure, and reducing cost and process complexity of the compressor. The problem that the friction and loss of the compressor are increased due to operation of the bearing is solved, and even reliability reduction of the bearing due to shortage of oil does not need to be considered.

Figure 3:
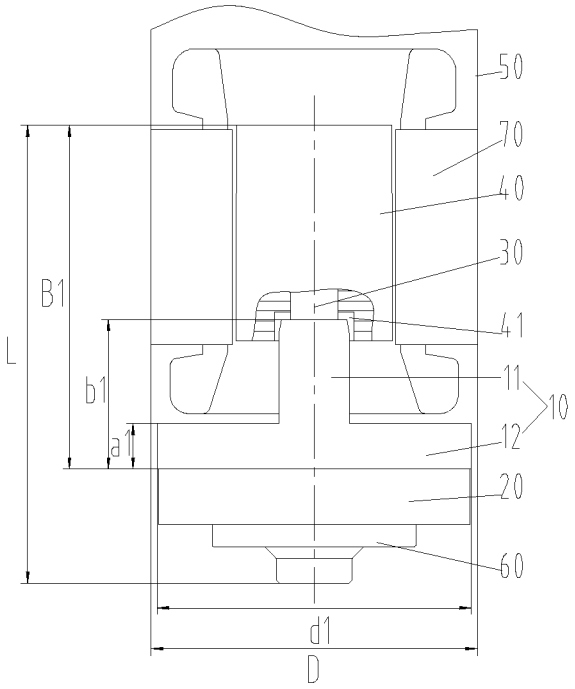
FIG. 3 is a schematic diagram of a local structure of a compressor shown in FIG. 2 under an ideal condition.
Figure 4:
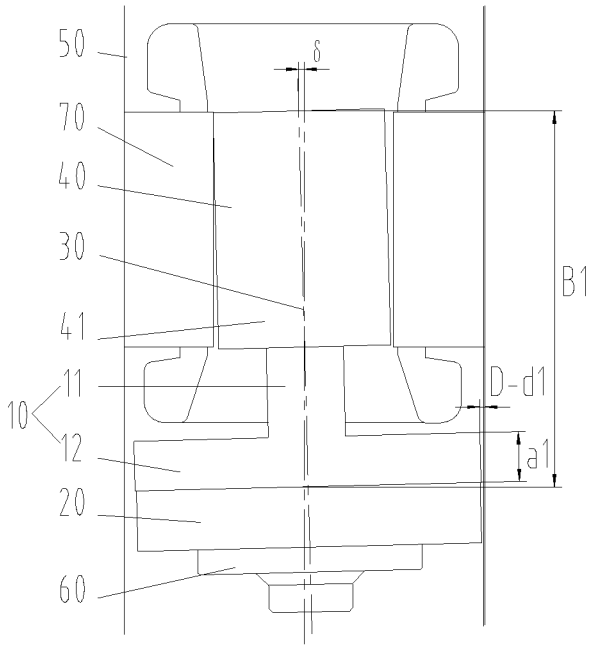
FIG. 4 is a schematic diagram of a local structure of a compressor shown in FIG. 2 under a deviated condition.

As shown in FIG. 2-FIG. 4, the motor assembly of the embodiment includes a rotor 40 sleeved on the rotating shaft 30 and a stator 70 disposed outside the rotor 40, and the stator is fixed inside the housing 50 in a manner of interference fit to drive the rotor 40 to rotate. At the moment, coaxiality of the upper flange 10 and the housing 50 after being welded determines coaxiality between the whole pump body assembly and the housing 50. Meanwhile, the rotor 40 is coaxial with the rotating shaft 30, therefore the coaxiality between the pump body assembly and the housing 50 determines coaxiality between the rotor 40 and the stator 70, namely, the coaxiality of the upper flange 10 and the housing 50 after being welded determines the coaxiality between the rotor 40 and the stator 70. In this way, it is ensured that the coaxiality between the upper flange 10 and the housing 50 after being welded is crucial to reliability, stable operation and noise of the compressor.

As shown in FIG. 3, an inner diameter D of the housing 50 is greater than an outer diameter d1 of the upper flange 10, and the housing 50 and the upper flange 10 are in clearance fit. A width of an outer wall of the upper flange 10 is a1, and a distance between an upper end surface of the rotor 40 and a lower end surface of the upper flange 10 is B1. It is expected that a central shaft of the pump body assembly is coaxial with a central shaft of the housing 50, and a central shaft of the rotor 40 is coaxial with a central shaft of the stator 70 as far as possible during designing assembling.

As shown in FIG. 4, when the upper flange 10 achieves a maximum deviation inside the housing 50, a maximum deviation δ of a top end of the rotor 40 is: $\delta=B1*(D-d1)/a1$. Therefore, when the distance B1 between the top end of the rotor 40 and the lower end surface of the upper flange 10 is fixed, the maximum deviation δ of the top end of the rotor 40 is reduced only through reducing a gap (D−d1) between the inner diameter D of the housing 50 and the outer diameter d1 of the upper flange 10 or appropriately increasing the width a1 of the outer wall of the upper flange 10. Due to a tolerance generated due to actual processing of a compressor portion, the gap (D−d1) between the inner diameter D of the housing 50 and the outer diameter d1 of the upper flange 10 need be ensured, as to ensure smooth assembling. Therefore, appropriate increase of the width a1 of the outer wall the upper flange 10 becomes an optimal solution of reducing the maximum deviation δ of the top end of the rotor 40, as to ensure the coaxiality between the rotor 40 and the stator 70 and ensure the reliability of the compressor.

Figure 5:
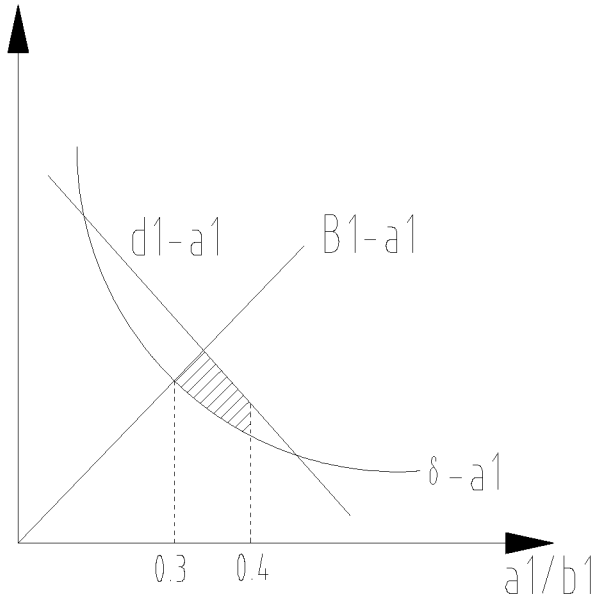
FIG. 5 is a schematic diagram of a relationship curve of all parameters in a compressor shown in FIG. 3.

Because a crank shaft generates a deflection when rotating at a high speed during actual operation of the compressor, the maximum deviation δ of the top end of the rotor 40 needs to be less than a design gap of a motor. According to a formula: maximum deviation $\delta=B1*(D-d1)/a1$, it is obtained that the maximum deviation δ is in direct proportion to B1/a1, and in inverse proportion to a1/B1, namely, the greater the a1/B1 is, the smaller the maximum deviation δ will be. Namely, the maximum deviation δ is greatly reduced by increasing the width a1 of the outer wall of the upper flange 10 and reducing the distance B1 between the top end of the rotor 40 and a supporting plane of the upper flange 10 as far as possible. According to the formula: maximum deviation $\delta=B1*(D-d1)/a1$, it is obtained that the maximum deviation δ is in inverse proportion to the width a1 of the outer wall of the upper flange 10, as shown by a δ−a1 curve in FIG. 5. Namely, the greater the width a1 of the outer wall of the upper flange 10 is, the smaller the maximum deviation δ will be. Through conversion of the formula, it is obtained that $B1=a1*\delta/(D-d1)$, namely, B1 is in direct proportion to a1, as shown by a straight line B1−a1 in FIG. 5. Similarly, through conversion of the formula, it is obtained that $d1=D-a1*\delta/B1$, namely, d1 is in negative proportion to a1, as shown by a straight line d1−a1 in FIG. 5. Meanwhile, due to limitation of a space of a lower cavity of the stator 70, the width a1 of the outer wall of the upper flange 10 does not be increased too much. In addition, if the motor is required to provide a sufficient torque, stacking of the rotor 40 does not be lowered similarly. Meanwhile, for ensuring restriction on the rotating shaft 30 by the upper flange 10, a height b1 of the upper flange 10 does not be reduced similarly. Therefore, the width a1 of the outer wall of the upper flange 10 is limited within an appropriate scope. As shown in FIG. 5, an area of a dash area is an optimal proportion scope obtained through theoretical calculation and testing and capable of achieving the abovementioned effect.

A height a1 of a disc portion 11 and a distance B1 between the upper end surface of the rotor 40 and a lower end surface of the disc portion 11 satisfy: $0.15\leq a1/B1\leq 0.25$. The height a1 of the disc portion 11 and a distance L between the upper end surface of the rotor 40 and a lower end surface of the lower flange 60 satisfy: $0.05\leq a1/L\leq 0.15$. The height a1 of the disc portion 11 and a width (D−d1) of the gap satisfy: $100\leq a1/(D-d1)\leq 140$, where, D is the inner diameter of the housing 50, and d1 is a diameter of the disc portion 11 of the pump body assembly.

Further, as shown in FIG. 2 and FIG. 3, a lower end surface of the rotor 40 of the embodiment is provided with a concave portion 41, and an upper end surface of a neck portion 12 extends into the concave portion 41. A fitting relationship between the rotor 40, the rotating shaft 30 and the upper flange 10 is enhanced by the concave portion 41 and the neck portion 12, and the coaxiality is improved accordingly.

Figure 6:
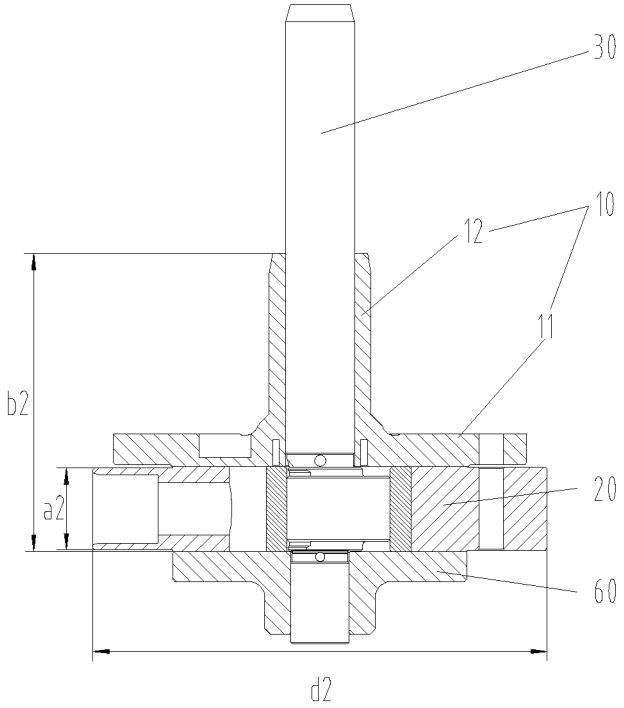
FIG. 6 is a relationship diagram of a1/b1 and a minimum gap between a stator and a rotor in a compressor shown in FIG. 3.

As shown in FIG. 6, through verification by a practical prototype, along increasing a1/b1, the greater a ratio of the height a1 of the disc portion 11 of the upper flange 10 to a distance b1 between an upper end surface of the neck portion 12 and a lower end surface of the disc portion 11 is, the greater a gap between the stator 70 and the rotor 40 will be. The gap mentioned here is a minimum distance between the stator and the rotor. Because an inner surface of the stator 70 and an outer surface of the rotor 40 are respectively similar to a column, the minimum distance between the stator and the rotor is 0, namely, the stator 70 is not coaxial with and is in contact with the rotor 40, and when the distance between the stator and the rotor achieves a maximum, namely, a distance between any position on the stator 70 to a position corresponding to the rotor 40 is equal, the stator 70 is coaxial with the rotor 40. Therefore, the a1/b1 is increased, and the gap between the stator 70 and the rotor 40 becomes greater and greater. In this way, the stator and the rotor are ensured to have better coaxiality.

The compressor of the embodiment effectively ensures coaxiality of axes of the upper flange and the housing, in this way an axis of the rotating shaft 30 and the axis of the housing 50 are basically kept on an identical straight line, and accordingly the gap between the housing 50 and the pump body assembly is ensured. Similarly, the gap between the stator 70 and the rotor 40 is even and kept with an ideal size, thereby solving the noise due to an uneven magnetic pull generated when the rotor rotates and disturbance to a refrigerant flow, and further reducing noise of the compressor.

As shown in FIG. 2 and FIG. 3, the pump body assembly of the embodiment is welded on the housing 50 through the disc portion 11, the cylinder 20 is connected with the disc portion 11 and the lower flange 60 through a fastener, respectively, as to achieve a purpose of fixing the pump body assembly.

In other embodiments not shown in the drawings, as an alternative, the pump body assembly is provided with a support welded and fixed on the housing, the disc portion is fixedly disposed on the support, and the cylinder is connected with the disc portion and the lower flange through the fastener, respectively.

The compressor of the embodiment is a vertical single-cylinder compressor having a dispenser, and the dispenser is connected with a cylinder of the pump body assembly, as to filter an impurity in a refrigerant before the refrigerant enters into the cylinder. In other embodiments not shown, as an alternative, the compressor is a multi-cylinder compressor, or a horizontal compressor.

Figure 7:
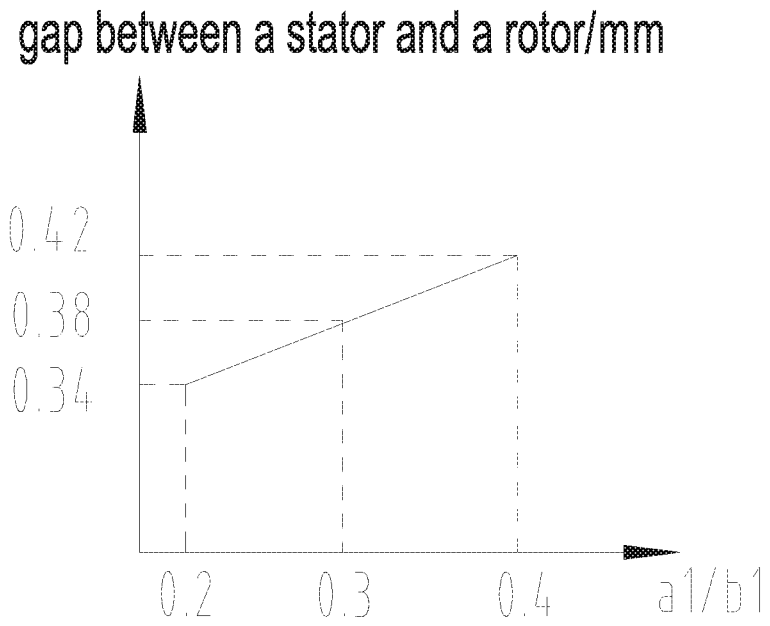
FIG. 7 is a schematic diagram of a section structure of an embodiment 2 of a pump body assembly according to the present disclosure.

The pump body assembly in the embodiment 2 changes a fixed connection mode with the housing. Specifically, as shown in FIG. 7, an outer peripheral surface of the cylinder 20 of the pump body assembly of the embodiment is connected with the housing of the compressor. For achieving an effect close to that of the embodiment 1, a height of the outer peripheral surface of the cylinder 20 of the embodiment is a2, a distance between the upper end surface of the neck portion 12 and the lower end surface of the cylinder 20 is b2, and a2 and b2 satisfy: $0.2 \leq a2/b2 \leq 0.3$. The diameter of the cylinder of the embodiment is d2, and a2 and d2 satisfy: $0.1 \leq a2/d2 \leq 0.2$.

Preferably, the outer peripheral surface of the cylinder 20 of the embodiment is welded and connected with the housing of the compressor.

The present disclosure further provides an air conditioner. The air conditioner according to the embodiment (not shown in the drawing) includes a compressor, and the compressor is the compressor having the abovementioned technical features. The air conditioner of the embodiment has low noise, stable operation and long service life.

From the description above, the abovementioned embodiment of the present disclosure achieves the following technical effects.

A ratio of a height of a disc portion of a upper flange to a diameter of the disc portion and a ratio of the height of the disc portion to a total height of the upper flange are improved, and the upper flange of the embodiment, from upper flanges of identical diameter, has a greater height of the disc portion, and accordingly there is a greater fitting area between the disc portion and a housing. When applied to the compressor housing of inner diameter, the flange of the present disclosure has a smaller inclined angle. Accordingly, coaxiality of a motor is improved, probability of sweeping is reduced, noise is reduced, and reliability of the compressor is improved.

In the descriptions of the disclosure, it is to be understood that orientation or position relationships indicated by nouns of locality including "front", "back", "upper", "lower", "left", "right", "transverse, longitudinal, vertical, horizontal", "top", "bottom" and the like are orientation or position relationships often shown based on in the drawings, are adopted not to indicate or imply that indicated devices or components must be in specific orientations or structured and operated in specific orientations when there is no contrary description available but only to conveniently describe the disclosure and simplify descriptions and thus should not be understood as limits to the disclosure. Moreover, terms "inside" and "outside" are defined as the inside and outside relative to outline of each portion.

In order to facilitate description, a spatial relative term may be used here, such as "over", "above", "on an upper surface" and "on", to describe a spatial location relation between a device or a feature shown in the drawing and other devices or other features. It is to be understood that the spatial relative term aims at including different orientations of the device during use or operation outside the orientation described in the drawing. For example, if the device in the drawing is inverted, it may be described as that the device "above other devices or other structures" or "over other devices or other structures" shall be positioned "under other devices or other structures" or "below other devices or other structures". Therefore, an exemplary term "above" may include two orientations: "above" and "under". As an alternative, the device may be positioned with other different modes (80° rotation or positioned at other orientations), and the spatial relative description used here needs to be explained correspondingly.

In addition, It is to be noted that terms "first", "second" and the like are adopted to limit the parts, as to merely facilitate distinguishing corresponding parts. Unless otherwise stated, the abovementioned terms do not have special meanings and should not be understood to limit the scope of protection of the disclosure accordingly.

The above is only the preferred embodiment of the present disclosure and not intended to limit the present disclosure. For those skilled in the art, the present disclosure may have various modifications and variations. Any modifications, equivalent replacements, improvements and the like made within the spirit and principle of the present disclosure shall fall within the scope of protection of the present disclosure.

What is claimed is:

1. A compressor, comprising a pump body assembly, wherein the pump body assembly comprises: an upper flange, the upper flange comprising a disc portion and a neck portion extending upward from the disc portion, an outer peripheral surface of the disc portion being connected with a housing of a compressor, a height a1 of the disc portion and a distance b1 between an upper end surface of the neck portion and a lower end surface of the disc portion satisfying: $0.3 \leq a1/b1 \leq 0.4$, and the height a1 of the disc portion and a diameter d1 of the disc portion satisfying: $0.1 \leq a1/d1 \leq 0.2$;

wherein, the compressor further comprises a rotating shaft provided inside the pump body assembly in a penetrating manner and a rotor sleeved on the rotating shaft, and the height a1 of the disc portion and a distance B1 between an upper end surface of the rotor and a lower end surface of the disc portion satisfy: $0.15 \leq a1/B1 \leq 0.25$.

2. The compressor as claimed in claim 1, wherein, the compressor further comprises the rotating shaft provided inside the pump body assembly in a penetrating manner and the rotor sleeved on the rotating shaft, the pump body assembly further comprises a cylinder and a lower flange, the lower flange is disposed under the upper flange, the cylinder is disposed between the upper flange and the lower flange, and the height a1 of the disc portion and a distance L between the upper end surface of the rotor and a lower end surface of the lower flange satisfy: $0.05 \leq a1/L \leq 0.15$.

3. The compressor as claimed in claim 1, wherein, a lower end surface of the rotor is provided with a concave portion, and the upper end surface of the neck portion extends into the concave portion.

4. The compressor as claimed in claim 2, wherein, the compressor further comprises a housing sleeved outside the pump body assembly, there is a gap between the housing and the pump body assembly, and the height a1 of the disc portion and a width (D−d1) of the gap satisfy: $100 \leq a1/(D-d1) \leq 140$, wherein, D is an inner diameter of the housing, and d1 is a diameter of the disc portion of the pump body assembly.

5. The compressor as claimed in claim 4, wherein, the disc portion is welded on the housing, and the cylinder is connected with the disc portion through a fastener.

6. The compressor as claimed in claim 4, wherein, the compressor further comprises a support welded and fixed on the housing, the disc portion is fixedly disposed on the support, and the cylinder is connected with the disc portion through the fastener.

7. The compressor as claimed in claim 1, wherein, the compressor is a single-cylinder compressor or a multi-cylinder compressor.

8. The compressor as claimed in claim 1, wherein, the compressor is a vertical compressor or a horizontal compressor.

9. An air conditioner, comprising the compressor as claimed in claim 1.

10. The air conditioner as claimed in claim 9, wherein, the compressor further comprises the rotating shaft provided inside the pump body assembly in a penetrating manner and the rotor sleeved on the rotating shaft, the pump body assembly further comprises a cylinder and a lower flange, the lower flange is disposed under the upper flange, the cylinder is disposed between the upper flange and the lower flange, and the height a1 of the disc portion and a distance L between the upper end surface of the rotor and a lower end surface of the lower flange satisfy: $0.05 \leq a1/L \leq 0.15$.

11. The air conditioner as claimed in claim 9, wherein, a lower end surface of the rotor is provided with a concave portion, and the upper end surface of the neck portion extends into the concave portion.

12. The air conditioner as claimed in claim 10, wherein, the compressor further comprises a housing sleeved outside the pump body assembly, there is a gap between the housing and the pump body assembly, and the height a1 of the disc portion and a width (D−d1) of the gap satisfy: $100 \leq a1/(D-d1) \leq 140$, wherein, D is an inner diameter of the housing, and d1 is a diameter of the disc portion of the pump body assembly.

13. The air conditioner as claimed in claim 12, wherein, the disc portion is welded on the housing, and the cylinder is connected with the disc portion through a fastener.

14. The air conditioner as claimed in claim 12, wherein, the compressor further comprises a support welded and fixed on the housing, the disc portion is fixedly disposed on the support, and the cylinder is connected with the disc portion through the fastener.

15. The air conditioner as claimed in claim 2, wherein, a lower end surface of the rotor is provided with a concave portion, and the upper end surface of the neck portion extends into the concave portion.

* * * * *